US005205661A

United States Patent [19]

Kato

[11] Patent Number: 5,205,661

[45] Date of Patent: Apr. 27, 1993

[54] PRINTER HAVING CONTINUOUS PAPER/CUT PAPER CHANGEOVER APPARATUS

[75] Inventor: Hiroyuki Kato, Nagoya, Japan

[73] Assignee: Brother Kogyo Kabushiki Kaisha, Nagoya, Japan

[21] Appl. No.: 848,317

[22] Filed: Mar. 9, 1992

[30] Foreign Application Priority Data

Apr. 12, 1991 [JP] Japan ..... 3-24115[U]

[51] Int. Cl.[5] ..... B41J 11/50

[52] U.S. Cl. ..... 400/605; 400/607.2

[58] Field of Search ..... 400/578, 605, 607.2, 400/608.2, 608.4, 611, 616, 616.1, 616.2, 624, 568, 607, 639, 639.1, 639.2

[56] References Cited

U.S. PATENT DOCUMENTS

| | | | |
|---|---|---|---|
| 4,360,279 | 11/1982 | Sugiura | 400/605 |
| 4,452,543 | 6/1984 | Adkisson et al. | 400/605 |
| 4,498,795 | 2/1985 | Tatara | 400/637.1 |
| 4,514,740 | 4/1985 | Fujiwara et al. | 400/636.1 |
| 4,522,520 | 6/1985 | Takenoya et al. | 400/636.1 |
| 4,615,630 | 10/1986 | Maeshima | 400/608.3 |
| 4,647,233 | 3/1987 | Noda et al. | 400/120 |
| 4,688,957 | 8/1987 | Prevignano | 400/605 |
| 4,691,911 | 9/1987 | Nakagawa et al. | 400/605 |
| 4,778,296 | 10/1988 | Takahashi | 400/708 |
| 4,847,633 | 7/1989 | Piatt et al. | 400/605 |
| 4,875,790 | 10/1989 | Karube et al. | 400/605 |
| 4,909,497 | 3/1990 | Itabashi | 400/605 |
| 4,913,574 | 4/1990 | Yokoi | 400/605 |
| 4,929,104 | 5/1990 | Yokoi | 400/605 |
| 5,011,313 | 4/1991 | Sato | 400/605 |
| 5,026,183 | 6/1991 | Oshima et al. | 400/605 |
| 5,030,024 | 7/1991 | Seshimo | 400/605 |
| 5,087,142 | 2/1992 | Suzuki et al. | 400/616 |

FOREIGN PATENT DOCUMENTS

| | | | |
|---|---|---|---|
| 60-981 | 1/1985 | Japan . | |
| 71673 | 4/1987 | Japan | 400/605 |
| 63-84958 | 4/1988 | Japan . | |
| 246264 | 10/1988 | Japan | 400/605 |
| 2125339A | 3/1984 | United Kingdom . | |

*Primary Examiner*—Edgar S. Burr
*Assistant Examiner*—Ren Yan
*Attorney, Agent, or Firm*—Oliff & Berridge

[57] ABSTRACT

The invention provides a printer where a continuous paper/cut paper changeover lever for changing over a continuous paper print mode and a cut paper print mode can be smoothly tuned so as to reduce a load on a drive mechanism and improve durability. A platen gear and a continuous paper/cut paper changeover lever at an end of a platen shaft, the platen gear is fitted to the outer periphery of the end of the platen shaft and fastened thereto by a pin. The continuous paper/cut paper changeover lever is fitted onto the outer peripheral portion of an extension portion of the platen gear. Engagement pawls of the continuous paper/cut paper changeover lever engage an engagement projection formed on a boss portion of the platen gear to be engageably held in a turnable manner relative to the boss portion of the platen gear.

10 Claims, 6 Drawing Sheets

PRINTER HAVING CONTINUOUS PAPER/CUT PAPER CHANGEOVER APPARATUS

BACKGROUND OF THE INVENTION

1. Field of the Invention

The invention relates to a printer where a print head performs a print operation onto print paper while a paper feeder feeds the print paper onto a platen.

2. Description of Related Art

There is known a conventional printer having a continuous paper/cut paper changeover lever for changing over between a continuous paper print mode where a drive force of a drive mechanism is transmitted to a platen and a paper feeder for feeding continuous paper and a cut paper print mode where the drive force is only transmitted to the platen.

In the known conventional printer, the changeover lever is rotatably supported on an end of a platen shaft and is prevented from moving in an axial direction of the platen by a stop ring. Therefore, an engaging groove which engages with the stop ring has to be formed on the end of the platen shaft. Consequently, the structure necessary for assembling the changeover lever is complex and it is difficult for an operator to assemble the changeover lever.

SUMMARY OF THE INVENTION

An object of the present invention is to provide a printer having a continuous paper/cut paper changeover apparatus wherein the structure for assembling the continuous paper/cut paper changeover lever is simple and assembly of the lever is easy.

In order to achieve the above object, the printer according to the present invention comprises: a platen rotatably supported on a frame via a platen shaft and extending in one direction; a print head movable reciprocally in a longitudinal direction parallel to the platen to perform a print operation with respect to a print paper placed on the platen; a paper feeder disposed in the frame; a drive mechanism disposed in the frame having a platen gear fittingly secured to the platen shaft and a gear train for rotatably driving the paper feeder; and changeover means for connecting/disconnecting the paper feeder to/from the drive mechanism, wherein the platen gear is provided with an extension portion extending from one side surface toward the axial direction thereof and the changeover means comprises a continuous paper/cut paper changeover lever for changing over the state of the changeover means which is supported on the extension portion of the platen gear in such a manner as to be turned relative to the platen gear.

In the printer structured as described above, the continuous paper/cut paper changeover lever is disposed on the extension portion of the platen gear with the platen gear fittingly secured to the end portion of the platen shaft. In this state, the continuous paper/cut paper changeover lever is supported only on the extension portion of the platen gear. Consequently, the continuous paper/cut paper changeover lever for changing over the platen and the drive mechanism for the paper feeder from the continuous paper print mode to the cut paper print mode can be smoothly turned on the platen gear irrespective of the concentricity of the outer diameter of the engagement projection with respect to the inner diameter into which the platen shaft is inserted, thus reducing the load on the drive mechanism and improving durability. Further, the structure for assembling the continuous paper/cut paper changeover lever is simple and assembly of the lever is easy.

BRIEF DESCRIPTION OF THE DRAWINGS

The invention will be described with reference to the figures in which.

DETAILED DESCRIPTION OF THE PREFERRED EMBODIMENT

Figure 1:
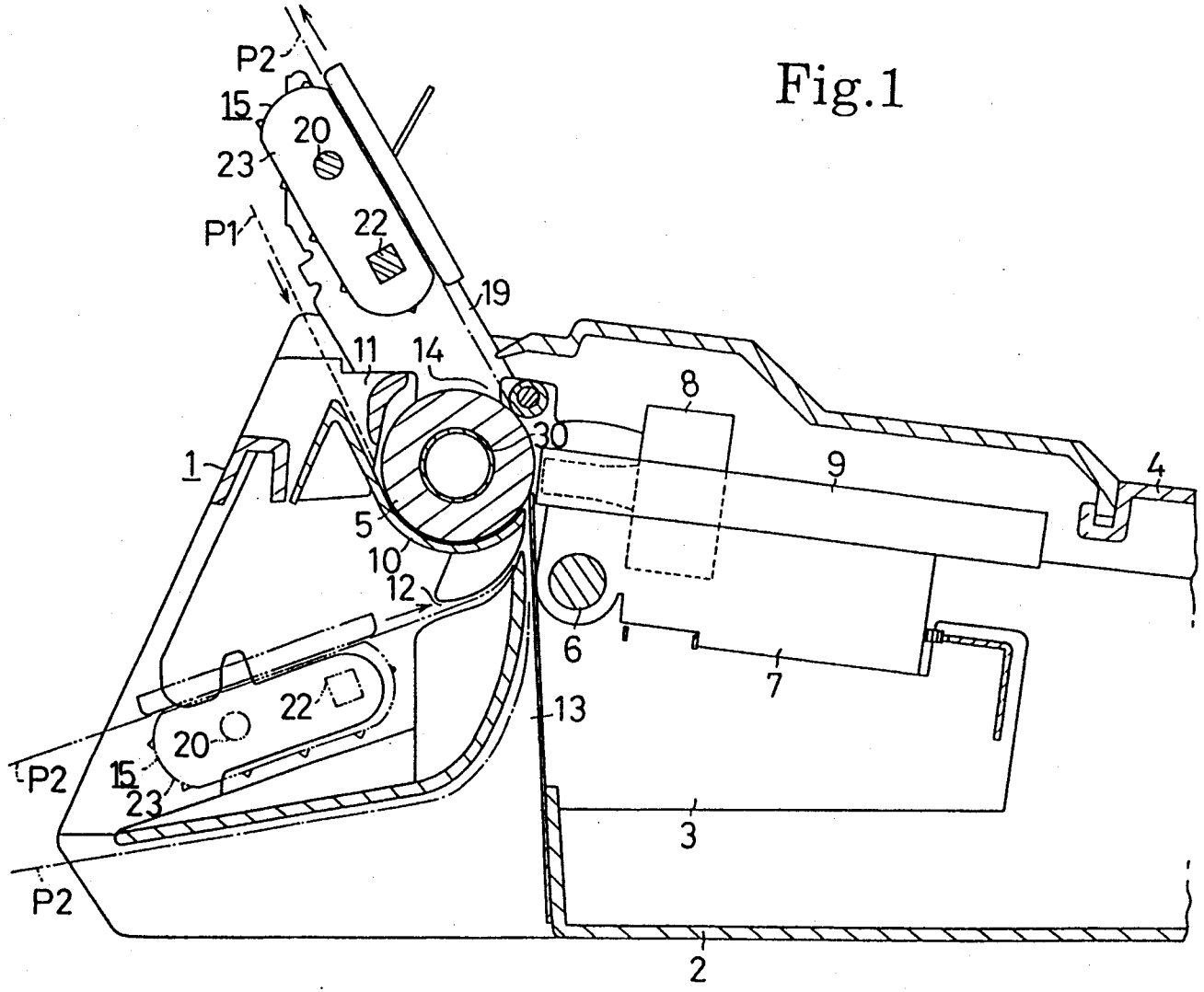
FIG. 1 is a partially sectional view showing a printer embodying the present invention.

As shown in FIG. 1, a frame 1 of the printer of the invention has a casing 2 made of a synthetic resin and having an opening at the upper side thereof, a chassis 3 made of plate steel and housed inside the casing 2, and a cover 4 made of a synthetic resin and mounted on the casing 2.

A platen 5 is rotatably held between both side plates of the chassis 3. A guide rod 6, as a guide member, is disposed between the side plates of the chassis 3 in such a manner as to extend parallel to the longitudinal direction of the platen 5.

A carriage 7 is supported for reciprocal movement along the length of the guide rod 6. Above the carriage 7 is mounted a print head 8 for performing a print operation with respect to print paper P1, P2 placed on the platen 5. Also mounted, detachably, on the carriage 7 is a ribbon cassette 9.

A paper guide 10 is installed above the casing 2 adjacent to the outer, lower periphery of the platen 5. Cut print paper P1 is supplied from an upper paper supply port 11 formed in the cover 4 and onto the platen 5 along the paper guide 10. A rear paper supply port 12 and a lower paper supply port 13 are formed behind and under the casing 2, respectively, with continuous paper P2 being supplied onto the platen 5 from the paper supply ports 12, 13. A paper discharge port 14 is formed in the upper portion of the cover 4, and the print paper P1, P2, after a printing operation by the print head 8, is discharged from the paper discharge port 14.

A paper feeder 15 is detachably disposed in the chassis 3 of the frame 1. The paper feeder 15 can be installed in a position opposite to the paper discharge port 14 on a paper feed-out side, beyond the platen 5 as shown by a solid line in FIG. 1, or in a position opposite to the rear paper supply port 12 on a paper feed-in side beyond the platen 5 as depicted by a chain line in FIG. 1.

When the paper feeder 15 is installed on the paper feed-out side, with respect to the platen 5, the continuous print paper P2 supplied from the lower side of the casing 2 through the lower paper supply port 13 is fed out from the paper discharge port 14 by means of the paper feeder 15 after passing through a print position on the platen 5. When the paper feeder 15 is installed on the paper feed-in side with respect to the platen 15, the continuous print paper P2 is fed onto the platen 5 from the rear paper supply port 12 by means of the paper feeder 15, to be discharged from the paper discharge port 14 after passing through the print position.

Figure 2:
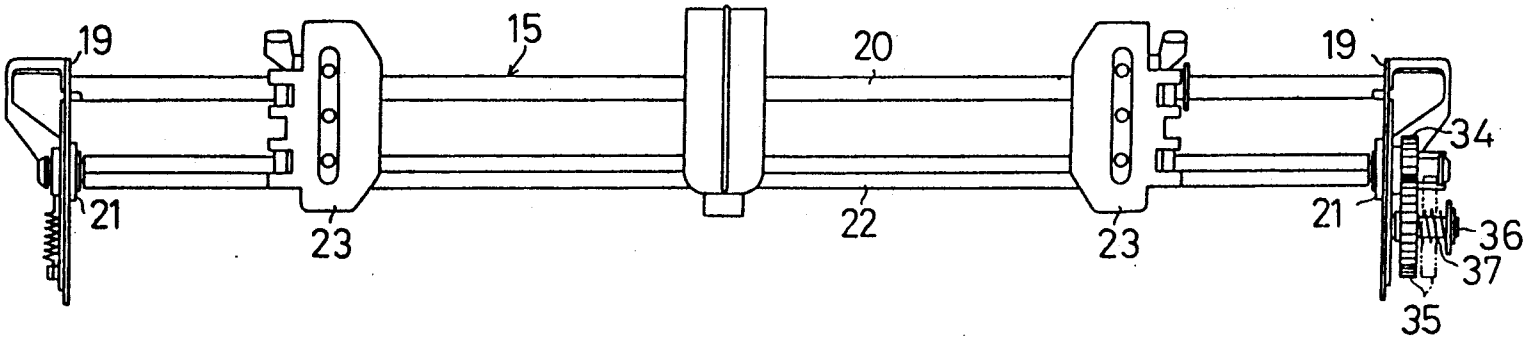
FIG. 2 is a front view showing a paper feeder.

As illustrated in FIGS. 1 and 2, the paper feeder 15 comprises a pair of right and left support plates 19, a support rod 20 disposed between the support plates 19, a rotary shaft 22 rotatably held between the support plates 19 via bearings 21 so as to extend parallel to the support rod 20, and a pair of pin tractors 23 movably supported on the support rod 20 and the rotary shaft 22. The rotary shaft 22 is rotated with the pin tractors 23 engaged with feed perforations formed at both side edges of the continuous print paper P2 so that the continuous print paper P2 is fed via the pin tractors 23.

Figure 3:
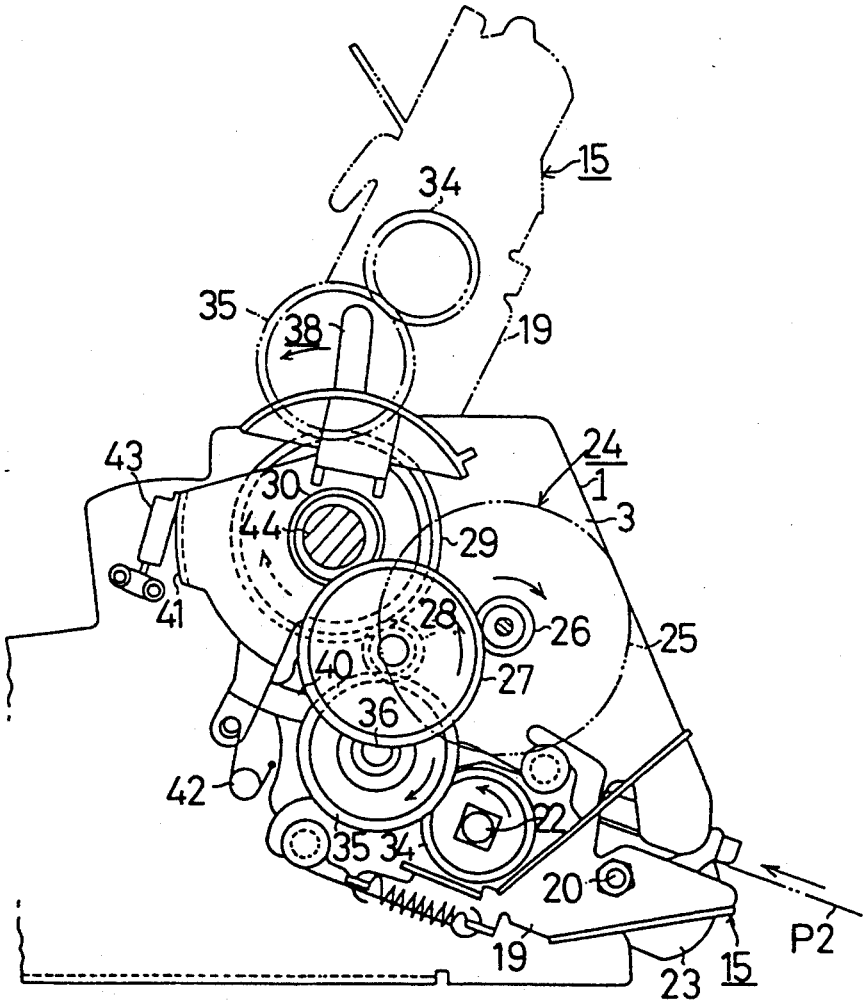
FIG. 3 is a partial sectional view showing a drive mechanism for rotating a platen and the paper feeder.
Figure 4:
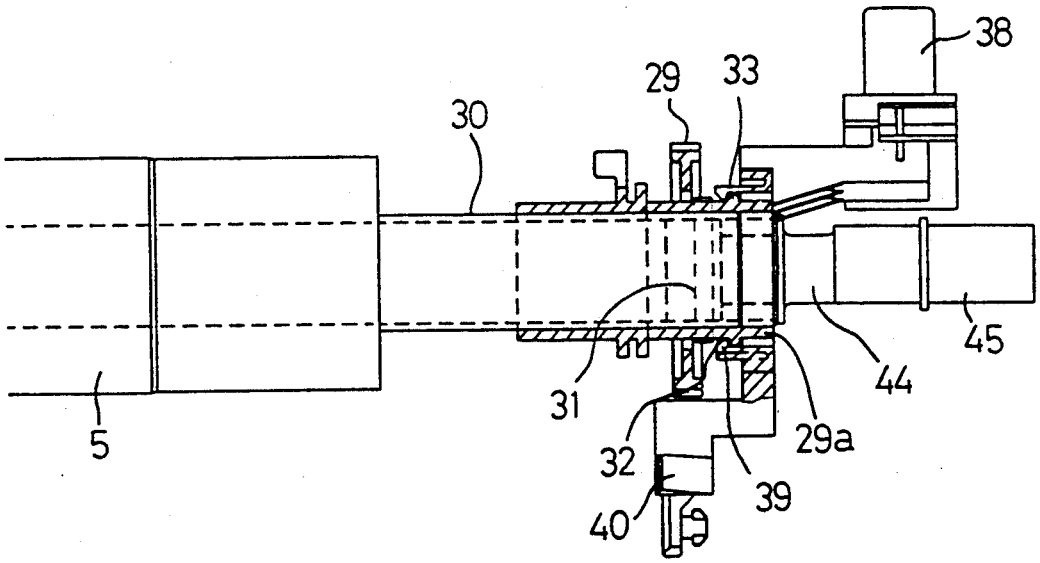
FIG. 4 is a sectional view showing the support structure of a platen gear and a continuous paper/cut paper changeover lever with respect to a platen shaft.

As depicted in FIGS. 3 and 4, a drive mechanism 24 is attached to an outer surface of the chassis 3 (the right outer surface to one facing the printer shown in FIGS. 1 and 2), and comprises a motor 25 and a gear train having a plurality of gears 26, 27, 28. A platen gear 29 is connected, and fixed by a pin 31, to the right end of a platen shaft 30 for supporting the platen 5 in such a manner as to be meshed with the gear 28 of the gear train. An annular engagement projection 33 is formed in a boss portion 32 at an outer side of platen gear 29. The platen gear 29 is also provided with an annular extension portion **29*a* projecting from the engagement projection 33 in the axial direction. Upon rotation of the motor 25, the platen 5 is rotated via the gears 26 through 28, platen gear 29 and platen shaft 30** to feed the print paper P1, P2.

As shown in FIGS. 2 and 3, a drive gear 34 is secured to the right end of the rotary shaft 22 at the outer surface of the right support plate 19 of the paper feeder 15. A connection gear 35 is supported on a support shaft 36 at the outer surface of the right support plate 19 for rotation and movement in the axial direction in such a manner as to be detachably meshed with the drive gear 34. Connection gear 35 is urged to a position that is meshed with the drive gear 34 by a spring 37.

As depicted by the solid line in FIG. 3, when the paper feeder 15 is installed in the position on the paper feed-in side with respect to the platen 5, the connection gear 35 is meshed with the gear 28 of the gear train so that the rotation of the gear 28 is transmitted to the rotary shaft 22 via the connection gear 35 and the drive gear 34, thus rotating the pin tractors 23.

Whereas, as shown by the two-dot chain line in FIG. 3, when the paper feeder 15 is installed in the position on the paper feed-out side with respect to the platen 5, the connection gear 35 is meshed with the platen gear 29 so that the rotation of the platen gear 29 is transmitted to the rotary shaft 22 via the connection gear 35 and the drive gear 34 to thereby rotate the pin tractors 23.

Figure 5:
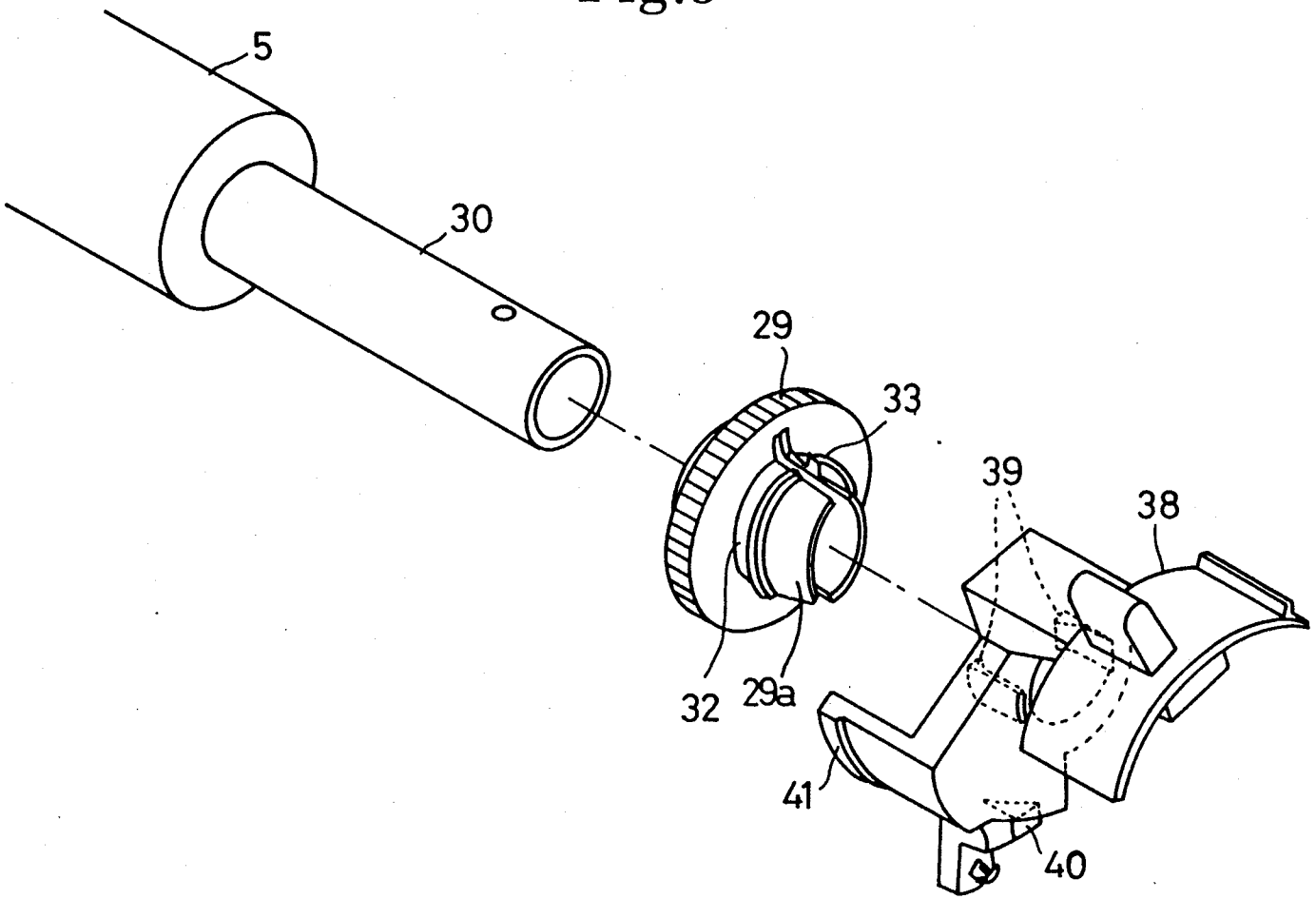
FIG. 5 is an exploded perspective view of principle parts of FIG. 4.

As illustrated in FIGS. 3 through 5, a continuous paper/cut paper changeover lever 38 is turnably supported on the outer right end of the platen shaft 30. On the continuous paper/cut paper changeover lever 38, there are provided a pair of engagement pawls 39 that are engageable with the engagement projection 33 of the platen gear 29. There are also provided on the continuous paper/cut paper changeover level 38, an engagement piece 40, that is engageable with the inner surface of the connection gear 35 of the paper feeder 15, and a switch operating portion 41. Engagement of the engagement pawls 39 with the engagement projection 33 allows the continuous paper/cut paper changeover lever 38 to be enagagedly kept for rotation relative to the boss portion 32 of the platen gear 29. A torque spring 42 is stretched between the continuous paper/cut paper changeover lever 38 and the chassis 3 for urging the continuous paper/cut paper changeover lever 38 to remain in the set position of the continuous paper print mode as depicted in FIG. 3 or in the set position of the cut paper print mode as shown in FIG. 6.

A changeover switch 43 is attached to the outer surface of the chassis 3 to be engageably disposed opposite to the switch operating portion 41 of the continuous paper/cut paper changeover lever 38. As illustrated in FIG. 3, when the continuous paper/cut paper changeover lever 38 is changed to the set position for the continuous paper print mode, with the paper feeder 15 installed in the position on the paper feed-in side with respect to the platen 5, the changeover switch 43 is turned on upon its engagement with the switch operating portion 41 so that a program for drivingly controlling the motor 25 of the drive mechanism 24 is set in the continuous paper print mode. Further, the engagement piece 40 is disengaged from the connection gear 35 of the paper feeder 15 so that the connection gear 35 is kept in engagement with the drive gear 34.

Figure 6:
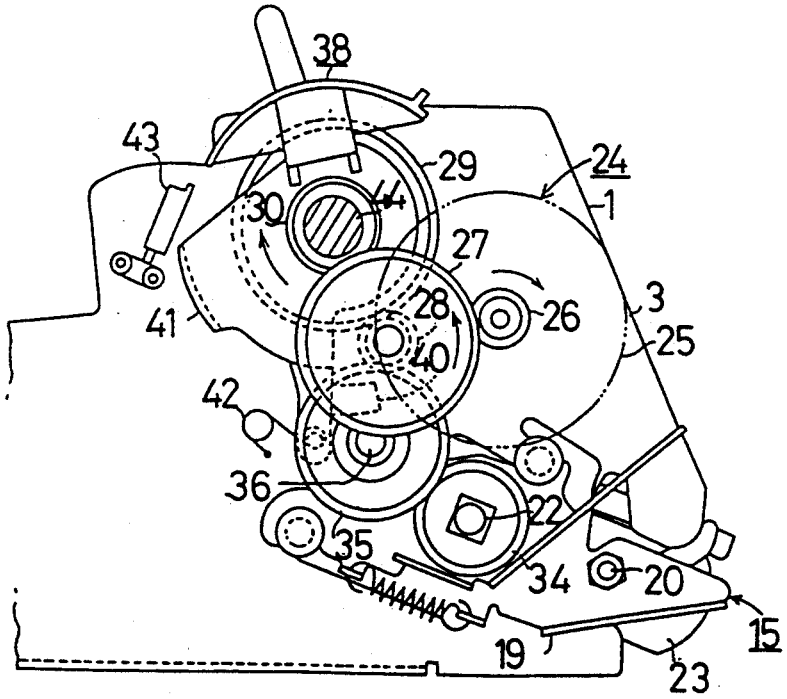
FIG. 6 is a partial sectional view showing the continuous paper/cut paper changeover lever which is changed from a set position for a continuous paper print mode to a set position for a cut paper print mode.

As shown in FIG. 6, when the continuous paper/cut paper changeover lever 38 is changed to the set position for the cut paper print mode, the changeover switch 43 is turned off by separation from the switch operating portion 41 so that the program is set to the cut paper print mode. In this setting, the engagement piece 40 is engaged with the connection gear 35 of the paper feeder 15 so that the connection gear 35 is moved to a position separate from the drive gear 34 against the energizing force of the spring 37 as shown by the chain line in FIG. 2.

As illustrated in FIG. 4, a knob support rod 44 is fitted into the platen shaft 30 at the end mounting the platen gear 29 and is also fastened by the pin 31. A knob 45 for a manual operation is fixed to the end of the knob support rod 44. The turning operation of the knob 45 permits the platen 5 to be rotated via the knob support rod 44 and the platen shaft 30.

In the printer structured as described above, the platen gear 29 and the continuous paper/cut paper changeover lever 38 are disposed at the right end of the platen shaft 30 with the platen gear 29 fitted to the outer periphery at the right end of the platen shaft 30 and fastened by the pin 31. The continuous paper/cut paper changeover lever 38 is fitted to the outer periphery of the extension portion **29*a* of the platen gear 29. The engagement pawls 39 of the continuous paper/cut paper changeover lever 38 are engaged with the engagement projection 33 formed on the boss portion 32 of the platen gear 29, and the continuous paper/cut paper changeover lever 38 is relatively rotatably held by the boss portion 32 of the platen gear 29. Accordingly, the continuous paper/cut paper changeover lever 38 can be smoothly rotated irrespectively of concentricity of an outer diameter of the boss portion 32 with respect to an inner diameter of the platen gear 29 inserted onto the platen shaft 30**.

The operation of the printer having the above described structure will be explained hereunder.

The chain line in FIG. 1 and the solid line in FIG. 3 show the paper feeder 15 installed on the paper feed-in side with respect to the platen 5. In this state, the connection gear 35 on the paper feeder 15 side is meshed with the gear 28 of the gear train in the drive mechanism 24. In the state shown in FIG. 3, the continuous paper/cut paper changeover lever 38 is changed to the set position of the continuous paper print mode. Accordingly, the changeover switch 43 is turned on by the engagement with the switch operating portion 41 so that the program for drivingly controlling the motor 25 of the drive mechanism 24 is set in the continuous paper print mode and, additionally, the engagement piece 40 is disengaged from the connection gear 35 of the paper feeder 15 so that the connection gear 35 is kept engaged with the drive gear 34.

Consequently, in this engaged state, when the printer is activated, after the continuous print paper P2 is installed in the pin tractors 23 of the paper feeder 15, the paper is fed from the rear paper supply port 12 through the print position on the platen 5 and the paper discharge port 14. The platen 5 is rotated via the gears 26 through 29 and the platen shaft 30 by means of the motor 25 of the drive mechanism 24. Further, the pin tractors 23 are rotated via the gears 35, 34 of the paper feeder 15 and the rotary shaft 22 so that the print head 8 performs the print operation with respect to the continuous print paper P2 while the continuous print paper P2 is fed to the print position on the platen 5.

In case of the print operation with respect to the cut print paper P1, with the paper feeder 15 installed on the paper feed-in side with respect to the platen 5, the continuous paper/cut paper changeover lever 38 is turned from the set position of the continuous paper print mode shown in FIG. 3 to the set position of the cut paper print mode illustrated in FIG. 6. The switch operating portion 41 is separated from the changeover switch 43 together with the movement of the continuous paper/-cut paper changeover lever 38 so that the changeover switch 43 is turned off. Accordingly, the program is set in the cut paper print mode and the engagement piece 40 is engaged with the connection gear 35 of the paper feeder 15. As a result, the connection gear 35 is moved to the position to be disengaged from the drive gear 34 against the energizing force of the spring 37 as depicted by the chain line in FIG. 2.

Consequently, in this state, when the printer is activated after the cut print paper P1 is fed from the upper paper supply port 11 to the print position on the platen 5, the platen 5 is rotated via the gears 26 through 29 and the platen shaft 30 by means of the motor 25 of the drive mechanism 24 so that the print head 8 performs the print operation with respect to the out print paper P1 while the cut print paper P1 is fed to the print position on the platen 5.

When the paper feeder 15 is changed from the position on the paper feed-in side with respect to the platen 5 to the position on the paper feed-out side, the connection gear 35 on the paper feeder 15 side is meshed with the platen gear 29 as shown by the chain line in FIG. 3. In this state, when the printer is activated after the continuous print paper P2 is fed to the pin tractors 23 of the paper feeder 15 from the lower paper supply port through the print position on the platen 5 and the paper discharge port 14, the platen 5 is rotated by the motor 25 of the drive mechanism 24 via the gears 26 through 29 and the platen shaft 30 while the print head 8 performs the print operation with respect to the continuous print paper P2 in the print position on the platen 5. In addition, the pin tractors 23 are rotated via the gears 35, 34 of the paper feeder 15 and the rotary shaft 22, thus drawing the continuous print paper P2 from the print position on the platen 5.

What is claimed is:

1. A printer, comprising:

a frame;

a platen shaft rotatably supported on said frame;

a platen mounted on said platen shaft and extending in one direction;

a print head movable reciprocally in a longitudinally direction parallel to said platen to perform a print operation with respect to a print paper placed on said platen;

a paper feeder disposed in said frame;

a drive mechanism disposed in said frame and having a platen gear fittingly secured to the platen shaft and a gear train rotatably driving said paper feeder; and changeover means for connecting/disconnecting said paper feeder to/from said drive mechanism, wherein the platen gear is provided with an extension portion extending from one side surface toward the axial direction thereof and the changeover means comprises a continuous paper/cut paper changeover lever for changing over the state of said changeover means, lever being said continuous paper/cut paper changeover lever being supported on said extension portion of the platen gear in such a manner as to be turnable relative to the platen gear.

2. The printer as claimed in claim 1, wherein the extension portion further comprises a radially extending annular boss portion, said boss portion having an axially extending engagement portion extending toward said platen; and said continuous paper/cut paper changeover lever has at least one engagement pawl engaging said engagement portion of said boss portion to rotatably retain said continuous paper/cut paper changeover lever on said extension portion.

3. A printer, comprising:

a printer body;

a support chassis having two sides mounted in said printer body;

a platen shaft rotatably supported between said two sides of said support chassis;

a platen mounted on said platen shaft;

guide means mounted between said two sides parallel to said platen;

a print head mounted for reciprocal movement along said guide means;

a paper feeder for feeding continuous paper mounted between said two sides of said support chassis;

a drive mechanism mounted to one of said two side frames, said drive mechanism driving both said platen shaft and said paper feeder;

changeover means for connecting/disconnecting said paper feeder to/from said drive mechanism; and a platen gear secured to an end of said platen shaft providing a connection for said changeover means, said platen gear further comprising an extension portion extending axially along and around said platen shaft and said changeover means comprises a changeover assembly which is rotatably connected to said extension portion, said changeover assembly rotating independently of said platen and platen gear.

4. The printer as claimed in claim 3, wherein the extension portion further comprises a radially extending annular boss portion, said boss portion having an axially extending engagement portion extending toward said platen; and said changeover assembly has at least one engagement pawl engaging said engagement portion of said boss portion to rotatably retain said changeover assembly on said extension portion.

5. The printer as claimed in claim 4, wherein the printer further comprises a state switch mounted to a surface of said one of said two sides of said support chassis; and said changeover assembly further comprises an extension for manually rotating said changeover lever, and a switch operating portion for contacting said state switch.

6. The printer as claimed in claim 4, the printer further comprising a gear train between said drive mechanism and said paper feeder.

7. The printer as claimed in claim 6, wherein said changeover assembly further comprises an engagement means for disconnecting said gear train between said drive mechanism and said paper feeder.

8. The printer as claimed in claim 7, wherein said paper feeder is movable between a position above said platen for feeding paper out from said platen and a position below said platen for feeding paper onto said platen.

9. A printer, comprising:

a frame;

a platen shaft rotatably supported on said frame;

a platen mounted on said platen shaft and extending in one direction;

a print head movable reciprocally in a longitudinal direction parallel to said platen to perform a print operation with respect to a print paper placed on said platen;

a paper feeder disposed in said frame;

a drive mechanism disposed in said frame and having a platen gear fittingly secured to the platen shaft and a gear train rotatably driving said paper feeder, said platen gear being provided with an annular engagement portion; and changeover means for connecting/disconnecting said paper feeder to/from said drive mechanism, said changeover means having a continuous paper/cut paper changeover lever for changing over the state of said changeover means, wherein said continuous paper/cut paper changeover lever is provided with at least one engagement pawl for engaging said annular engagement portion of said platen gear, whereby said continuous paper/cut paper changeover lever is rotatably supported by said platen gear and is prevented from moving in the one direction by said platen gear.

10. The printer as claimed in claim 9, wherein said platen gear further comprises an extension portion extending axially from said annular engagement portion and said continuous paper/cut paper changeover lever is rotatably seated on said extension portion.

* * * * *